United States Patent [19]

Boe

[14] 3,969,559

[45] July 13, 1976

[54] MAN-MADE TEXTILE ANTISTATIC STRAND

[75] Inventor: Norman Wendell Boe, Gulf Breeze, Fla.

[73] Assignee: Monsanto Company, St. Louis, Mo.

[22] Filed: May 27, 1975

[21] Appl. No.: 581,397

[52] U.S. Cl. ..... 428/87; 428/97; 428/372; 428/374; 428/394; 428/395; 428/397

[51] Int. Cl.[2] ..... D02G 3/00; D03D 27/00

[58] Field of Search ..... 428/372, 374, 394, 395, 428/397, 370, 364, 87, 97; 139/426 R; 317/2 R, 2 C

[56] References Cited

UNITED STATES PATENTS

| | | | |
|---|---|---|---|
| 2,931,091 | 4/1960 | Breen | 428/370 X |
| 3,192,295 | 6/1965 | Settele | 428/370 X |
| 3,803,453 | 4/1974 | Hull | 317/2 R |
| 3,849,242 | 11/1974 | Takeya et al. | 428/224 |

*Primary Examiner*—Lorraine T. Kendell
*Attorney, Agent, or Firm*—Stanley M. Tarter

[57] ABSTRACT

A novel biconstituent filament, such as multifilament or monofilament yarn or staple fiber, useful for dissipating static electricity from normally static prone textile articles comprising a first constituent substantially adhered lengthwise to a second constituent is provided. The first constituent is made of a synthetic thermoplastic fiber-forming polymer that is virtually non-conductive to electricity. The second constituent is a normally non-conductive synthetic thermoplastic fiber-forming polymer rendered electrically conductive by having dispersed uniformly throughout a sufficient quantity of electrically conductive carbon black to provide an electrical resistance of less than $1 \times 10^{10}$ ohms per centimeter for each filament at a direct current potential of 0.1 volt as measured at 20% relative humidity and 21°C. The cross sectional area of the second constituent comprises from about 1 to 30 percent of the cross sectional area of the whole filament. The first constituent partially encapsulates the second constituent in an amount of at least 50 percent. The interface between the two constituents is curvate in shape and extends from one side to the other of the filament. Textile articles containing only a small amount of such filaments are rendered antistatic and retain such property even after prolonged use.

11 Claims, 3 Drawing Figures

MAN-MADE TEXTILE ANTISTATIC STRAND

BACKGROUND OF THE INVENTION

1. Field of the Invention

This invention is concerned with novel and useful antistatic biconstituent strands and textile products made at least in part from said strands.

2. Description of the Prior Art

It is well known that static electricity is generated and transferred as one walks on conventional carpet structures made from synthetic hydrophobic fibrous materials, as for example nylon fibers, acrylic fibers, polyester fibers and the like. When a person walking across such a surface later becomes grounded, a flow of accumulated electrons occurs through that part of the individual's body which by chance comes in contact with a ground. This discharge may occur by touching a door knob, metal cabinet, etc. When such electrical build-up exceeds 3500 volts, the electric shock is quite annoying to most people and can cause considerable personal discomfort. Many approaches have been suggested to eliminate or reduce the static electricity in fabrics in order to give much more comfort to the consumer and to reduce the danger of explosion where explosive materials may be present in the vicinity of fabric utilization.

It has been suggested to randomly intermingle a small amount of metal fibers or metal plated polymer fibers among synthetic hydrophobic fibers to reduce the static propensity of products made therefrom. This approach gives rise to considerable added cost and the resulting metallic glitter may be undesirable.

The use of fibers made of synthetic polymer having electrically conductive carbon black uniformly dispersed throughout has been suggested. However, such carbon-loaded filaments cannot be produced at economically high speeds at low cost. Moreover, the filaments tend to be brittle and thus are easily broken.

It has also been suggested to paste coat filaments with conductive substances or to soften the surface of a synthetic polymer filament and thereafter to cause electrically conductive carbon black to be deposited on and to adhere to the surface. Unfortunately, these approaches are expensive, slow speed operations; and obtaining uniformity of deposition is fraught with difficulties. In the aforementioned instances where carbon black is employed, the presence of the black filaments is quite noticeable in light colored textile goods because of a tell-tale gray appearance imparted thereto.

In U.S. Pat. No. 3,803,453 a sheath-core antistatic filament is described. The core component comprises preferably a minor amount of the filament and contains electrically conductive carbon black. In this way the blackness to a large extent is hidden, provided that the percent of core in the filament is less than 50. By completely encasing such a core component with a sheath of non-conductive polymer, one can realize only a very small part of the conductivity provided by the carbon black. While this known type of filament is somewhat effective in instances where the static buildup greatly exceeds 5000 volts, it has been found to be quite ineffective in reducing the static electricity below the 3500 volt level of normal human sensitivity.

It is also well known to produce a bicomponent filament of dissimilar materials by joining the same in a stratified flow of polymer melts through a spinnerette assembly without intimate mixing of the materials.

Incorporating carbon black in a polymer drastically changes its flow behavior. Normally, when polymers having pronouncedly different flow behaviors are conjugated in a side-by-side arrangement to produce a bicomponent filament, there is an undesirable tendency for one component to fracture or to separate from the other so as to form a split filament.

There exists a real need in the field of man-made fibers to provide an electrically conductive strand of excellent pliability and flexibility that will permanently aid in the elimination of static electricity when intermingled even in minor amounts with static-prone fibers and yet that is relatively inexpensive to produce.

SUMMARY OF THE INVENTION

The present invention provides a novel man-made biconstituent strand conveniently and inexpensively produced that is sufficiently electrically conductive such that incorporation of very minor amounts thereof into textile articles, for example carpets, renders the same substantially free of buildup of bothersome static electricity. One constituent is made of a relatively non-conductive synthetic thermoplastic fiber-forming polymer. This first constituent is substantially adhered lengthwise to the second constituent. A suitable amount of electrically conductive carbon black is incorporated in a matrix of a normally non-conductive synthetic thermoplastic fiber-forming polymer with such carbon-containing polymer being the material constituting the second constituent. The synthetic polymer of the two constituents may be of different polymer genera; preferably the polymers of both constituents are composed of the same genus. The second constituent is electrically conductive and has an electrical resistance of less than $1 \times 10^{10}$ ohms per centimeter per filament at a direct current potential of 0.1 volt as measured at 20% relative humidity and 21°C. The cross sectional area of the second constituent composes from about 1 to 30 percent of the total cross-sectional area of the composite structure. The interface between the two constituents is curvate, preferably convexo-concave but may be sigmoid or the like. When the strand is circular in cross section, the non-conductive constituent preferably has a crescentiform cross-section. The first constituent partially encapsulates the second constituent in an amount of at least 50 percent. The curvate interface and the partial encapsulation provide a better adhesion between the constituents. Preferably, the percent encapsulation of the second constituent by the first is between 66–95. With complete encapsulation the ability of the composite filament to dissipate static electricity is severely reduced. With percent encapsulation less than 50, the black portion becomes quite noticeable and may detract from the aesthetics of light colored articles made therefrom. Also, the composite filaments become difficult to produce by conventional melt co-spinning processes; and the filaments are difficult to draw without breakage thereof occurring. Generally speaking, the amount of carbon black will be sufficient to render the constituent electrically conductive. To accomplish this, amounts of about 15–50 weight percent of electrically conductive carbon black are incorporated in the conductive constituent. Below 15 percent the efficacy of static shock prevention is reduced. Above 50 percent compounding the polymer and the carbon black becomes very difficult with known procedures; and the resulting composition has substantially reduced fiber-forming character.

Nylon has been found to be the preferred polymer for use in both constituents. Noteworthy is the fact that biconstituent strands can be processed at high spinning and drawing speeds with maintenance of excellent interfacial constituent adherence and at the same time with avoidance of horizontal fracturing of the conductive constituent. Furthermore, the yarn can be drawtextured wherein the steps of drawing and texturing are simultaneous or sequential without greatly disrupting the electrical conductive continuity thereof.

DESCRIPTION OF THE DRAWING

In FIG. 3 the percent of encapsulation is greater than in FIG. 2.

DESCRIPTION OF PREFERRED EMBODIMENTS

Figure 1:
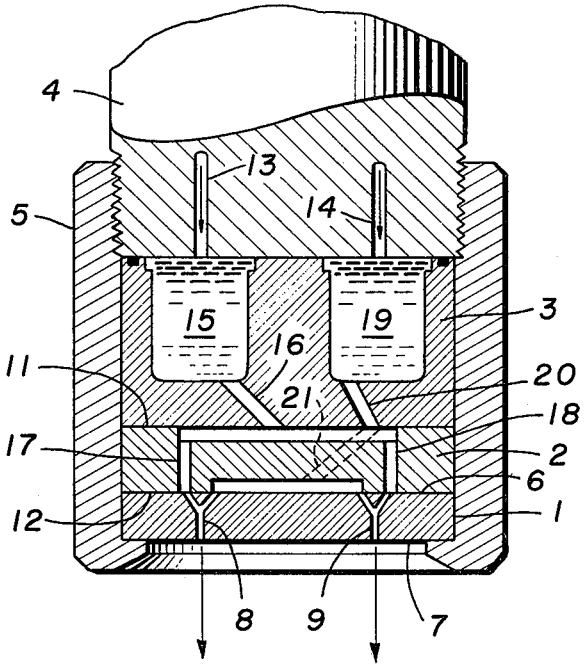
FIG. 1 is a view partly in vertical cross section showing a spinnerette assembly for accomplishing the present invention.
Figure 2:
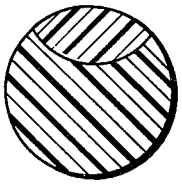
FIGS. 2 and 3 are cross sectional views of biconstituent melt spun filaments produced by using the spinnerette embodiment of FIG. 1.

Spinning of antistatic biconstituent filaments can be accomplished by using apparatus of FIG. 1. In such apparatus spinnerette plate 1, polymer distributor 2, polymer reservoir plate 3, and delivery element 4 are incorporated within coupling block 5. The spinnerette plate has melt delivery face 6 and melt extrusion face 7. Two capillaries or orifices 8 and 9 are shown wherein polymer conjugation is accomplished. Any suitable number of orifices can be employed. The capillaries are bifurcated in the upper portion. In operation the two polymers flow downwardly through each branch and converge into single laminal streams in the lower portion of the capillaries. The molten polymer streams emitted from the extrusion face are cooled to form filamentary yarn which can be further processed into textile articles and the like.

Molten polymer distributor 2 is a disc-like member and is contiguous therewith and superimposed on spinnerette plate 1. The distributor has upper face 11 and lower face 12 and is provided with an upper central cavity and a lower central cavity. Two polymers, one of which contains electrically conductive carbon black, are delivered from separate melters (not shown) via conduits 13 and 14. The polymer moving through conduit 13 flows into reservoir 15 and then through lines 16 and 17 to reach one of the branches of orifice 8. By way of conduit 18 the same polymer reaches one of the branches of orifice 9. The second polymer moving through conduit 14 flows into reservoir 19 and then through lines 20 and 21 to the lower cavity of distributor 2 to reach one of the branches of each of orifice 8 and orifice 9.

Normal care can be exercised to prevent oxidation and degradation of the polymer during melting and spinning by excluding oxygen-containing gases by the use of inert gas. The spun filaments can be taken up in suitable package form with various degrees of molecular orientation occurring prior to take up. It may be advantageous to spin the biconstituent filaments and collect the same such that there is little or no orientation of the polymer molecules. To obtain the best tensile properties of such as-spun filaments, they may be drawn several times their original length. Drawing can be done either at ambient temperature or preferably with the use of heated rolls, hot pins and the like, the best drawing mode being determined by the particular polymers used in the fibers and by other factors. Where nylon is used both in the non-conductive constituent and as the matrix polymer in the conductive constituent, the filament can be drawn at draw ratios of about 2–4 to a tensile strength of about 2 or more grams per denier.

The biconstituent filaments having low orientation are particularly suitable for being added in minor amounts to a larger bundle of normal non-conductive synthetic filaments prior to or during drawing or drawtexturing thereof. The addition of the biconstituent filaments at such times results in a more random intermingling thereof within the larger threadline. Thus, the small black longitudinal stripe of the biconstituent filament is virtually completely hidden. However, the biconstituent filaments may be drawn prior to incorporation in a larger threadline of previously drawn filaments. In such case the black stripe may be somewhat more visible unless entanglement is accomplished by use of a high pressure fluid jet or similar device.

The biconstituent filaments can be cut to desired staple lengths and blended with non-conductive staple fibers using conventional means. The blended fibers can then be spun into yarn having antistatic qualities.

The strands of the present invention can be used alone or preferably intermingled with other strands in the production of suitable textile articles produced by standard weaving, tufting, knitting, flocking, netting, braiding and other techniques. As low as about 0.1 weight percent of the fabric may be composed of the biconstituent filament with the remainder of the fabric comprising any of the natural or man-made fibers and filaments of today; and yet suitable static dissipation is attained. The upper limit of the amount of biconstituent strand employed is determined primarily by economic considerations. Ordinarily the fabric need not contain more than 10 weight percent biconstituent strands. Examples of fibers and filaments advantageously combined with the biconstituent strands are those made from acrylonitrile polymers, nylon polymers, aramid polymers, polyethylene terephthalate polymers, as well as those of cotton and wool.

The biconstituent filaments are conveniently and advantageously incorporated in continuous filament carpet yarn before drawtexturing thereof without the need of taking expensive precautions to assure nonbreakage of the antistatic filaments. Various drawtexturing techniques can be used. For example, one or more undrawn biconstituent filaments of suitable individual denier (1–30 drawn denier) can be directed to a yarn feeding means supplying carpet yarn of 800–4000 ultimate denier, for example, to drawtexturing devices of various kinds. The drawtexturing devices include hot-draw-gearcrimpers, draw-falsetwisters, draw-stuffer boxes either mechanically fed or hot fluid jet fed, and draw jet aspirating devices. Spinning and drawtexturing can be coupled in one continuous operation.

The polymer components of the constituents can be composed of any suitable thermoplastic fiber-forming polymers and copolymers. By "fiber-forming" is meant the property of linear, high molecular weight polymers making such capable of being formed into fibers of useful strength and toughness. The polymers include polyolefins such as polyethylenes and polypropylenes; polyamides and copolyamides (nylons), such as polyhexamethylene adipamide (nylon-66), polymeric $\epsilon$-caprolactam (nylon-6), polyaminoundecanoic acid, polymers of bis-paraaminocyclohexyl methane and undecanoic acid; polystyrenes; polyesters, such as those of polymeric hydroxycarboxylic acid esters and of terephthalic or isophthalic acids and lower alkylene glycols such as ethylene glycol and tetramethylene glycol; polyurethanes; polyureas; polycarbonates; polyvinyl halides; polyvinylidene halides, etc. For better adherence of the constituents in the filament, it is preferred that the polymers of both constituents be selected from the same polymer genus. Polymers may be modified by incorporation of delustrants, dye-enhancing materials, dye-resisting materials, etc. Nylon-66 containing no more than 0.2 weight percent delustrant, such as $TiO_2$, is the most preferred when it is desired that the biconstituent be the least detectable when added to a larger light colored threadline.

The carbon black compounded in the polymer of one of the constituents must be of the electrically conductive type and should retain its conductive nature in the textile article formed at least in part from the biconstituent filaments. By "electrically conductive carbon black" is meant any carbon black which has a specific or volume resistivity of less than 200 ohm-cms. as measured by ASTM Method D991-68. A resistance of less than 100 ohm-cms. is preferred. Typical carbon blacks meeting these requirements include Cabot Carbon Company (Boston, Mass.) Vulcan C and Vulcan XC-72 dry black and Columbia Carbon Company Conductex SC. Other blacks having similar low resistance properties can be used. The carbon black may be dispersed in the polymer forming the conductive constituent of the biconstituent filament by known mixing procedures. Excessive shearing of the black is to be avoided in that the conductivity of the black can be substantially reduced thereby. Sufficient dispersion of the black in the polymer should be accomplished under conditions that result in a minimum reduction in the conductivity character of the black.

The amount of carbon black compounded in the polymer of one of the constituents should only be sufficient to impart the desired low resistance to the electrically conductive component. By "electrically conductive" is meant that property manifested by a specific resistance of less than $1 \times 10^5$ ohm-centimeters. By "non-conductive" is meant that property manifested by a synthetic polymer filament having a specific resistance that is greater than $1 \times 10^8$ ohm-centimeters as similarly measured. As indicated above, carbon black amounts in the conductive constituent of 15–50 weight percent may be employed. Amounts of 25–35 weight percent provide the best level of conductivity without substantial sacrifice of processability of the material into suitable filaments.

The biconstituent filament is preferably round in cross section, although multi-lobal cross section may be desired for certain end uses. It is, however, important that the cross-sectional area of the conductive constituent composes only a minor amount of the total cross sectional area of the filament. Cross-sectional areas of the constituents are directly translatable into volumes of the respective constituents composing the filament. The cross-sectional areas of the conductive constituent should compose about 1 to 30 percent of the cross-sectional area of the filament. Preferably the percent is 3 to 12. Below 1 percent the effectiveness of the static electricity dissipation may be too low for many uses; and with such a low volume of such constituent, it is difficult to assure that the constituent is not completely sheathed with the non-conductive polymer component. When the percent of cross sectional area of the conductive constituent exceeds 30, adherence of the constituent is reduced, as well as the tensile strength of the filament since most of the tensile strength of the filament is derived from the non-conductive constituent. Drawn biconstituent filaments made of nylon as the polymer in both constituents have remarkably high strength values that can well exceed 2.5 grams per denier even though the conductive constituent contains as high as 29 percent carbon black and composes as much as 25 percent of the volume of the filament.

The interface of the two constituents should be curvate. The cross section of the non-conductive constituent normally has a crescent-like shape such that the non-conductive constituent partially encapsulates the conductive constituent. Providing such a cross section configuration insures better adherence between the two dissimilar constituents and reduces the noticeable presence of the black component on the surface of the filament to a mere stripe of low visibility. The non-conductive constituent partially encapsulates the black-containing constituent in an amount of at least 50 percent. Preferably, the average percent encapsulation should be between 66–95. By "percent encapsulation" is meant the percent of extrudate periphery occupied by the non-conductive constituent.

Even though as low as one part by weight biconstituent filament is used in 1000 parts of the fibrous material composing a carpet, such a carpet has a static electricity level below the discomfort value. Specifically, the carpet will have a maximum body electrical build up of less than 3500 volts at 20% relative humidity and 21°C.

DESCRIPTION OF TEST PROCEDURES

1. Measurement of electrical resistance

The measurement of electrical resistance of the biconstituent filament is accomplished by using a Model 610C solid state electrometer manufactured by Keithley Instruments Inc., Cleveland, Ohio. The binding posts of the instrument are provided with small spring clips silver-soldered on the ends thereof. A small amount of silver paste is placed on the clip ends to ensure good clip-to-yarn contact. The paste is the silver containing component of E-Solder 3021, a silver-filled epoxy resin sold by Epoxy Products, New Haven, Conn. The threadline to be tested in placed in one clip and attached to the second post under slight tension. The binding posts are 9 centimeters apart. An electrical potential of 0.1 volt is applied to the posts and the electrical resistance is measured. The electrical resistance is then determined in terms of ohms per centimeter length based on an individual filament.

2. Measurement of maximum body voltage build up

Maximum body voltage build up is measured as follows. The testing is conducted in a controlled humidity room maintained at 21°C. A 3 ft. × 12 ft. (0.91 m. × 3.66 m.) carpet is placed on a conventional waffle rubber carpet pad which lay on a concrete floor of the testing room. The adult human subject, wearing shoes with leather or Neolite soles and rubber heels, walks on the carpet sample. The subject carries a 1000:1 KV voltage divider probe. From the probe a lead runs to the input of a Keithley 610C electrometer. The output of the electrometer is then fed to a strip chart recorder. As the subject walks, the voltage increases to a steadystate maximum voltage after about 20 to 30 steps. The data are the result of the average of at least five body voltage build up measurements on two different subjects. Prior to testing the carpet samples are cleaned with a spray of hot aqueous detergent solution and a thorough hot water rinsing to remove excess surface finishes or lubricants. The samples are then thoroughly dried before being placed in the testing room to equilibrate.

3. Measurement of yarn specific resistance

Yarn specific resistance in ohm-cms. is calculated using the following formula $$\frac{\text{(electrical resistance) (denier of individual filament)}}{2 \times 10^6}$$

EXAMPLE I

Nylon-66 polymer chips of cube-like shape were prepared using a conventional polymerization autoclave, quenching device and cutter. The chips were suitable for melt spinning into filaments. The chips had the following composition:

Table 1

| | |
|---|---|
| Formic acid relative viscosity | 51 |
| % $TiO_2$ | 0.0 |
| Apparent melt viscosity (at shear rate of 20 $sec^{-1}$ and 285°C.) | 550 poise |

The chips were employed as the non-conductive constituent to prepare biconstituent filaments as will be described.

Nylon-66 polymer of the type just described above was loaded with electrically conductive carbon black sold under the trademark Vulcan C available from Cabot Corp. of Boston, Mass. The carbon black had the following reported analysis:

Table 2

| | |
|---|---|
| Fixed carbon | 98.5% |
| Volatiles | 1.5% |
| Particle size | 23 millimicrons |
| Surface area | 125 sq.meters/gram |
| Electrical resistivity | very low |

The carbon black was dispersed in the polymer by the following procedure. Predetermined amounts of nylon and carbon black are fed to No. 6 Ferrel Continuous Mixer operated in the normal manner for compounding carbon black into a high molecular weight linear polymer. The output of the mixer is fed to an extruder fitted with a multi-strand die. The extruded rods having a representative diameter of about 3 mms. were cut into small cylinders having an average length of about 3–6 mms. Pressed films made from this carbon black loaded nylon averaged 3.7 ohm-cms. in specific resistivity.

The carbon-containing polymer had the following analysis and was used as the conductive constituent to prepare biconstituent filaments as will be described.

Table 3

| | |
|---|---|
| % C | 32 |
| Specific resistivity | 3.7 ohm-cms. |
| Apparent melt viscosity (at shear rate of 20 $sec^{-1}$ and 285°C) | 24,000 poise |

The nylon-66 polymer and the carbon black-containing nylon-66 polymer were cospun into filaments using separate screw melters feeding a side-by-side biconstituent filament melt spinning apparatus as illustrated in FIG. 1. Specifically, nylon-66 polymer particulates were fed to a one and a half inch screw melter and the carbon black-containing nylon-66 polymer particulates were fed to a one and a half-inch screw melter of a conjugate yarn spinning machine for melting and delivering the two polymers to two separate metering pumps. These pumps were set to deliver predetermined amounts of each polymer to a spinning pack provided with a spinnerette. The pumping rates were varied at different times so that various percentages of the polymers composing the filaments in the various yarn samples were as follows:

Table 4

| Yarn | Nylon-66, % | Carbon-loaded Nylon-66, % | Spinnerette Temp., °C. | Spinning Speed meters/min. |
|---|---|---|---|---|
| A | 90 | 10 | 271 | 600 |
| B | 87 | 13 | 283 | 415 |
| C | 86 | 14 | 283 | 415 |
| D | 83 | 17 | 285 | 415 |
| E | 75 | 25 | 292 | 415 |

Ten capillaries were provided in the spinnerette. The two molten streams of polymers were brought together in a side-by-side arrangement and caused to flow together throughout the length of the capillaries. The capillary was circular in cross-section with a diameter of 13 mils (0.33 mm) and a length of 26 mils (0.66 mm). The screw melter used for melting the nylon-66 polymer was heated to 285°C. The screw melter used for melting the carbon-loaded nylon-66 was heated to 298°C. The temperature of the spinnerette was maintained as indicated in Table 4. The extruded biconstituent filaments were spun in a conventional melt spinning chimney having a cross flow of cooling air with a delivery temperature of 18°C. A known finish was applied to the filaments and the filaments were collected at speeds as set forth in Table 4 above. The 10 filaments were collected as five separate threadlines each composed of two filaments. The denier of the individual filaments as-spun was 83. The individual stripes of the filaments were continuous, thus indicating that even at the high spinning speeds employed no substantial rupturing of the carbon-containing component occurred during spinning.

EXAMPLE II

Yarn A was drawn as follows. The two filament threadline was withdrawn overend of a package and forwarded to a pair of feed rolls that delivered the threadline at a speed of 216 meters per minute to a rotating hot roll running at 225°C. and a speed of 271 meters per minute. Between the feed rolls and the hot roll the threadline made one wrap around a draw pin (diameter = 6.4 mm) at ambient temperature. From the hot roll the threadline was forwarded to a cold draw roll running with a peripheral speed of 751 meters per minute. Five wraps were taken by the threadline around the draw roll and its associated separator roll.

Figure 3:
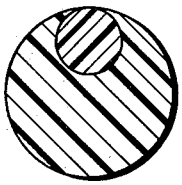

The thus drawn yarn was collected using a conventional ring-traveller take-up device. Photomicrographs were made of the cross sections of the filaments. The cross-sectional area was composed of approximately 90% nylon-66 and 10% black-containing nylon-66. The nylon-66 had a crescent-like shape as illustrated in FIG. 3 and partially encapsulated the black nylon component in an amount of about 92% The denier of the individual filaments was 23. The tenacity of the filaments averaged 2.2 grams per denier and the break elongation averaged 38% Average electrical resistance determined from samples taken from five pirns was $0.54 \times 10^6$ ohms per centimeter per filament. The yarn specific resistance was 17.7 ohm-cms.

A series of yarn was produced as above described in this example to show the operability of the drawing procedure using various hot roll temperatures while maintaining the draw ratio constant at 3.5. The following data were obtained and the tested yarn properties are averages of four determinations.

Table 5

| Hot Roll Temp. °C. | Electrical Resistance, ohms/cm./fil. | % Elongation | Tenacity gm./den. |
|---|---|---|---|
| 230 | $1.48 \times 10^6$ | 31 | 1.8 |
| 225 | $1.58 \times 10^6$ | 36 | 2.0 |
| 220 | $1.71 \times 10^6$ | 25 | 2.0 |
| 215 | $2.51 \times 10^6$ | 29 | 2.1 |
| 210 | $5.78 \times 10^6$ | 32 | 2.2 |
| 200 | $1.24 \times 10^7$ | 19 | 2.3 |

Thus, it is seen that the electrical resistance of the biconstituent filament is directly related to the temperature of the hot roll, whereas the tenacity is inversely proportional to the roll temperature. A reduction in electrical resistance may be gained with a slight loss in the tenacity of the filament.

Instead of employing a 3.5 draw ratio the drawing operation of this example was performed at 2.5 and 3.0 draw ratios and the electrical resistance of the biconstituent filaments determined. At a draw ratio of 2.50 the electrical resistance was $6.8 \times 10^5$ ohms/cm. per filament. At a draw ratio of 3.00 the electrical resistance was $1.06 \times 10^6$ ohms/cm. per filament. Thus, lower electrical resistance values are obtained at lower draw ratios. Again tenacity is sacrificed to obtain the improved resistance.

EXAMPLE III

The 46/2 biconstituent yarn of Example II was intermingled with a textured nylon-66 continuous filament carpet yarn composed of 204 filaments and having a total drawn denier of 3690 as follows. Undrawn nylon-66 yarn of trilobal cross section was stocked on a gear texturing machine as shown in U.S. Pat. No. 3,457,610. The yarn was passed between a driven feed roll and its associated idler cot roll. The yarn was then passed around a heated draw pin maintained at about 155°C. and then through the nip of two intermeshing toothed drawrolls that were driven at a peripheral speed several times greater than the speed of the feed roll so that the heated yarn was given an orientation stretch of 3.4 X while hot and was deformed and cooled as it passed several times through the gear members. The yarn was passed to a fluid jet as shown in U.S. Pat. No. 3,609,830 with an overfeed of 23 percent. In the jet the yarn was treated with steam at 185°C. to bulk the yarn and to impart some filament entanglement thereto.

EXAMPLE IV

Carpets were made using the composite yarn of Example III. In one case the composite yarn was used in every second end (0.6% biconstituent yarn) and in another case the composite yarn was used in every fourth end (0.3% biconstituent yarn). The carpet had a level loop pile construction with a height of 6.4 mms. and pile yarn content of 0.74 kilograms per square meter. The yarn was tufted into a non-woven polypropylene primary backing to form the pile fabric. The backing had a polypropylene reinforcing scrim. An aqueous dispersion of conventional natural rubber latex was applied to the backing. The small streaks of black coloration in the yarn were not detectable by the human eye with even the closest observation on the dyed carpet and so in no way detracted from the aesthetics of the carpet. The maximum body build up of static electricity at the standard conditions of 20% Relative Humidity and 21°C. were as follows:

Table 6

| Sole Composition | Every Second End | Every Fourth End |
|---|---|---|
| Leather | 2280 volts | 2800 volts |
| Neolite | 2080 volts | 2550 volts |

A control carpet of identical yarn makeup and construction but without conductive biconstituent yarn ends in it gave a body build up of 13,000 volts with leather soles and 12,330 volts with Neolite soles.

EXAMPLE V

Spun yarn A was drawn on a standard nylon filament drawtwister equipped with a 2½ inch diameter hot draw pin at 155°C. A drawing speed of 185 meters per minute was chosen and a series of drawings was performed at various pin temperatures and draw ratios, all with one wrap on the hot pin. Electrical resistance values per filament were obtained as follows:

Table 7

| Draw Ratio | Electrical Resistance, ohms/cm. |
|---|---|
| 2.5 | $0.82 \times 10^6$ |
| 3.0 | $1.36 \times 10^6$ |
| 3.5 | $2.88 \times 10^6$ |
| 4.0 | $5.56 \times 10^6$ |

Table 8

| Pin Temp., °C | Electrical Resistance, ohms/cm. |
|---|---|
| 235 | $0.82 \times 10^6$ |
| 230 | $0.91 \times 10^6$ |
| 225 | $1.36 \times 10^6$ |
| 200 | $2.44 \times 10^6$ |

For the drawing of the yarns whose electrical resistance is set forth in Table 7 a constant pin temperature of 225°C. was employed. For the drawing of the yarns whose electrical resistance is set forth in Table 8 a constant draw ratio of 3.0 was employed.

EXAMPLE VI

Spun Yarn A was fed with a bundle of nylon-66 continuous filament carpet yarn (1230/68-ultimate total denier/no. of filaments) to a gear texturizer and prebulker as disclosed in U.S. Pat. No. 3,457,610. A hot pin temperature of 195°C. was used along with a draw ratio of 3.00. Two different drawing speeds were employed. The drawn and textured conductive yarns were extracted from the larger threadlines and the individual filaments were tested for electrical resistance. In Table 9 these data are set forth:

Table 9

| Drawing Speed, m/min. | Electrical Resistance, ohms/cm. |
|---|---|
| 369 | $4.22 \times 10^6$ |
| 738 | $5.44 \times 10^6$ |

As can be seen from the above table, with the relatively high draw ratio and the low pin temperature the yarns show slightly increased resistance but conductivity is still regarded as excellent.

In order to show the conductivity of the biconstituent yarn when the yarn is textured under rather severe conditions, a sample of spun yarn A was combined with a spun carpet yarn. The combined bundle was texturized on the gear texturizer with a draw pin of only 150°C. and a rather high draw ratio of 3.45. As expected the electrical resistance per filament was higher, i.e., $1.7 \times 10^7$ ohms/cm. This yarn, even using one end out of every four (0.3% conductive biconstituent) showed good antistatic performance in carpet made as described in Example IV. A leather sole body voltage build up of 3250 volts was obtained when such carpet was tested. The resulting textured yarn was collected at a speed of 738 meters per minute on a paper tube using a conventional winder.

Drawn Yarn A of Example II was delivered to the filament ingression port of the fluid jet so that Yarn A was intermingled with the carpet yarn being bulked and tangled and was collected together. The composite yarn was examined. The presence of the two filaments having the small longitudinal black stripes was only detectable by very close scrutiny.

EXAMPLE VII

Three separate ends of 1230/64 nylon-66 continuous filament carpet yarn were drawn and gear crimped to provide a latent bulkiness therein by using apparatus as shown in U.S. Pat. No. 3,457,610. The ends were separately taken up using a ring-traveller take-up system; and thus, each end had a small amount of producer's twist of about 0.2 turns per inch. The polymer compositions of the ends were slightly different so that each dyed differentially. One end had regular dyeing properties. The second end contained about 0.4% by weight benzene phosphinic acid in the polymer composition to enhance its acceptance of acid dyes. The third end contained a small amount of 3,5 (disodium sulfonate) benzoic acid in the polymer composition to enhance its basic dyeability. The three ends were fed simultaneously along with two drawn Yarn A filaments to a bulking and filament entangling device as shown in U.S. Pat. No. 3,457,610 and were wound on a paper core as a cheese package. Thus, a differentially dyeable composite threadline of 3690 denier with two biconstituent filaments of the present invention was provided.

Using the composite yarn of this Example, a carpet was constructed in the manner described in Example IV. Again it was determined that the small stripes of black coloration in the yarn were not detectable. The Static Build Up of the carpet was reduced to a value below the threshold of normal human sensitivity.

EXAMPLE VIII

Polyurethane chips suitable for screw melt filament spinning were prepared. The urethane polymer was made from hydroxy terminated polyester of 1,4-butane diol and adipic acid (MW = 2000) modified with 4,4'-diphenyl methane diisocyanate and chain extended with 1,4-butane diol.

The urethane polymer was loaded with Cabot Vulcan C carbon black in an amount such that the black composed 32 weight percent of the compounded product. The mixing technique followed generally that described in Example I.

For the other constituent, nylon-6 having the following properties was used:

Table 10

| | |
|---|---|
| Formic acid relative viscosity | 35 |
| % $TiO_2$ | 0 |
| Melt Viscosity (at shear rate of 499 sec.$^{-1}$ and 224°C.) | 1380 poise |

The black loaded polymer had the following composition and properties:

Table 11

| | |
|---|---|
| Specific resistance (ohm-cms) | 15.4 |
| Melt viscosity (at shear rate of 150 sec.$^{-1}$ and 230°C.) | 2221 poise |

The nylon-6 polymer and the carbon black-containing urethane polymer were cospun into filaments using the spinning apparatus described in Example I. The metering pumps were adjusted so that the extruded filaments were composed of 25% black urethane plymer and 75% nylon-6 in a side-by-side arrangement. The melter used for melting the urethane polymer was heated to 235°C. The temperature of the spinnerette was maintained at 224°C. The extruded filaments were spun into a conventional spinning chimney having a cross flow of cooling air having a delivery temperature of 18°C. A known finish was applied to the filaments and the filaments were collected at a speed of 277 meters per minute. The denier of the individual filaments as-spun was 86.

EXAMPLE IX

The yarn of Example VIII was drawn as follows. The yarn was withdrawn overend of a package and fed to a pair of feed rolls that delivered the yarn at a speed of 97 meters per minute to a draw zone where the yarn was wrapped 1½ times around a 6.4 mm. diameter ceramic pin and pulled therethrough by a draw roll-separator roll device to draw the yarn 4.0 times. The drawn yarn was collected using a conventional ring traveller take-up. Photomicrographs were made of the yarn's cross section. The cross sectional area was composed of approximately 25% black urethane polymer and 75% nylon-6. The nylon section had a crescent-like shape as illustrated in FIG. 3 and partially encapsulated the black urethane component in the amount of about 65%. It was observed that each filament had a single fine longitudinally extending black stripe that was just barely visible to the naked eye. The electrical resistance per filament was measured and found to be $5.6 \times 10^7$ ohm./cm. The individual denier of the filament measured to be 20.

I claim:

1. A novel biconstituent filament useful for dissipating static electricity from normally static prone textile articles comprising a first constituent substantially adhered lengthwise to a second constituent, the first constituent being made of a non-conductive synthetic thermoplastic fiber-forming polymer, the second constituent being a normally non-conductive synthetic thermoplastic fiber-forming polymer rendered electrically conductive by having dispersed substantially uniformly throughout a sufficient quantity of electrically conductive carbon black to provide an electrical resistance of less than $1 \times 10^{10}$ ohms per centimeter at a direct current potential of 0.1 volt, the cross-sectional area of the second constituent comprising from about 1 to 30 percent of the cross-sectional area of the filament, and the first constituent partially encapsulating the second constituent in an amount of at least 50 percent and forming a curvate interface therewith extending from one side to the other side of the filament.

2. The biconstituent filament as defined in claim 1 wherein the interface is convexo-concave.

3. The biconstituent filament defined in claim 1 having been drawn at least 200% without breaking.

4. The biconstituent filament as defined in claim 1 wherein the percent encapsulation is between 66–95.

5. The biconstituent filament as defined in claim 1 wherein the amount of carbon black in the second constituent is about 15–50 weight percent.

6. the biconstituent filament as defined in claim 1 wherein the polymer of the first constituent is of the same polymer genus as the polymer of the second constituent.

7. The filament of claim 6 wherein the polymer genus is nylon.

8. The filament of claim 7 wherein the nylon is nylon-66.

9. The filament of claim 8 wherein the nylon contains at most 0.2 weight percent $TiO_2$.

10. A blend of synthetic polymer filaments or fibers having improved antistatic properties composed of at least 90 weight percent of synthetic filaments or fibers having normal static properties and at most 10 weight percent of biconstituent filaments as defined in claim 1.

11. A carpet having a maximum body voltage build up of less than 3500 volts at 20% relative humidity and 21°C. whose pile is composed at least in part of a bulky threadline formed of the blend as defined in claim 10.

* * * * *